US007955237B2

(12) United States Patent
Bisson

(10) Patent No.: US 7,955,237 B2
(45) Date of Patent: Jun. 7, 2011

(54) EXERCISE APPARATUS FOR THE UPPER BODY

(76) Inventor: Lise Bisson, DeWinton (CA)

( * ) Notice: Subject to any disclaimer, the term of this patent is extended or adjusted under 35 U.S.C. 154(b) by 0 days.

(21) Appl. No.: 12/208,112

(22) Filed: Sep. 10, 2008

(65) Prior Publication Data

US 2009/0239722 A1 Sep. 24, 2009

Related U.S. Application Data

(63) Continuation-in-part of application No. 12/050,475, filed on Mar. 18, 2008, now abandoned.

(51) Int. Cl.
*A63B 21/02* (2006.01)
*A63B 21/045* (2006.01)

(52) U.S. Cl. ..... 482/126; 482/127

(58) Field of Classification Search ..... 482/121, 482/49.121–49.122, 126–127, 44
See application file for complete search history.

(56) References Cited

U.S. PATENT DOCUMENTS

| | | | | | |
|---|---|---|---|---|---|
| 4,351,527 | A * | 9/1982 | Crisp, Jr. | 482/122 |
| 4,623,141 | A * | 11/1986 | Salvino | 482/49 |
| D322,827 | S * | 12/1991 | Bennstrom et al. | D21/684 |
| D341,401 | S * | 11/1993 | Reichman | D21/692 |
| D343,882 | S * | 2/1994 | Bennstrom et al. | D21/692 |
| 5,308,299 | A * | 5/1994 | Winston | 482/49 |
| 5,399,138 | A * | 3/1995 | Jones | 482/127 |
| 5,507,712 | A * | 4/1996 | Chang | 482/126 |
| 5,626,545 | A * | 5/1997 | Newman et al. | 482/127 |
| 5,743,830 | A * | 4/1998 | Ho | 482/44 |
| D460,505 | S * | 7/2002 | Yang | D21/684 |
| 7,008,354 | B2 * | 3/2006 | Wen | 482/127 |
| 7,077,787 | B1 * | 7/2006 | Wiesman | 482/49 |
| 2007/0027008 | A1 * | 2/2007 | Levinson et al. | 482/121 |

* cited by examiner

*Primary Examiner* — Loan Thanh
*Assistant Examiner* — Shila Abyaneh
(74) *Attorney, Agent, or Firm* — Schmid PA

(57) ABSTRACT

Disclosed is an apparatus for developing the upper body and in particular the chest. The apparatus includes opposed lever arms pivotally secured to each other at a fulcrum point located at the terminal ends of the opposed levers. The opposed lever arms are biased against each other and form a "V" shape. A counteracting force is needed to bring the handle ends of the levers together. The force required to bring the opposed handle ends together exercises the upper body of a user.

4 Claims, 5 Drawing Sheets

EXERCISE APPARATUS FOR THE UPPER BODY

RELATED APPLICATION

This application is a continuation-in-part of U.S. patent application Ser. No. 12/050,475, filed Mar. 18, 2008 now abandoned, the contents of which is hereby incorporated in its entirety.

TECHNICAL FIELD

The present invention relates to an exercise apparatus for the upper body and in greater detail the present invention includes a mechanical resistance apparatus and exercise routine for shaping and sculpting breasts.

BACKGROUND

Gravity is relentless and aging is inevitable. Together these ineluctable forces wreak havoc on our bodies, wrinkling us, thinning vertebral discs, weakening our bones, making us more susceptible to sickness and disease. But perhaps most vulnerable to the depredations of time and gravity are a woman's breasts which succumb to sagging due to the tug and pull of gravity.

Essentially, there are three known available means to provide or maintain attractive breasts. They include the use of support garments, cosmetic surgery, and exercise. Support garments can shape and support breasts in appealing ways. However, while offsetting some of the effect of gravity, brassieres do little to change or enhance the immediate appearance of the breasts themselves. Cosmetic surgery, while providing a quick and sometimes dramatic result, is dangerous, expensive, can result in long term health problems and an unnatural feel.

Exercise has none of the problems or limitations of cosmetic surgery and support garments. Outside of cosmetic surgery, the only effective means of enhancing breast appearance is to exercise the muscles supporting the breasts. But in contrast to cosmetic surgery, exercise is healthful and has long term health benefits, and in contrast to support garments, exercise actually changes the breast themselves.

Breast appearance cannot be improved by exercising the breasts since they do not contain muscle tissue. Breasts are composed of fat, glands and connective tissue. Sagging occurs when the skin and connective tissue stretch or break down due to gravity or through the loss of elasticity from aging. Sagging can also occur after a significant weight loss or a pregnancy, when skin and ligaments are temporarily stretched due to increased breast size.

Breasts can only be sculpted by increasing the mass of muscles supporting the breasts. Breasts are supported by the pectoral muscles, including the clavicular and sternal parts of the pectoralis major. The pectoralis major is a large muscle that spans both sides of the chest, originating at the medial two thirds of the clavicle, the anterior surface of the sternum, the cartilages of the first six ribs, and the slip from aponeurosis of external oblique abdominal muscle. Building the pectoral muscles generally produces about the same effect as breast augmentation surgery.

When breasts are surgically augmented, the effect is to urge breast tissue into the covering skin, thus making the breasts firmer and more buoyant, disposed more outwardly from the chest, rather than sagging or drooping downwardly. Building pectoral muscles accomplishes the same thing. The increased muscle mass pushes breast tissue outwardly and into the skin, thus tightening the skin and pulling the breasts upwardly. Additionally, breast appearance is enhanced by increasing the mass and tonicity in the pectoralis minor, the anterior deltoids, the serratus anterior, the coracobrachialis, and the subscapularis.

These muscles can be addressed in a conventional resistance training program of weight lifting. The better known suitable lifts would include the bench press, the inclined and declined presses, parallel bar dips, dumbbell or "pec deck flys," and dumbbell or barbell pullovers. But such a program entails the use of heavy weights and the execution of difficult, strenuous lifts. It may require the acquisition of a weight set or access to a gym facility, and some of the lifts can be genuinely dangerous if heavy weights are used without a spotter.

Therefore what is needed is a lightweight portable apparatus providing a simple, convenient, and inexpensive means to strengthen and tone the chest and shoulder muscles to lift and firm the breasts.

SUMMARY

The present invention comprises an apparatus for developing the upper body and in particular the chest. The apparatus includes opposed lever arms pivotally secured to each other at a fulcrum point located at the terminal ends of the opposed levers. The opposed lever arms are biased against each other such that a force is needed to bring the handle ends of the levers together. The force required to bring the opposed handles together exercises the upper body of a user.

In greater detail, the present apparatus for exercising the upper body includes a pair of opposed pivotally secured lever arms. The lever arms are secured to each other using the pivot assembly. The opposed lever arms are biased against each other such that the apparatus appears to form a "V" shape, wherein the terminal ends of the arms are secured at the base of the "V" and handle ends form the open arms of the "V". The biasing of the arms may be accomplished using a resilient member residing within the pivot assembly.

The resilient member may be a spring. The spring can be housed within the pivot assembly and connected in part to each of the levers whereby the spring is concealed within the apparatus. The apparatus may further include grips attached to the handle ends. The levers may be formed from a plastic.

The pivot assembly includes a first and a second opposed portion, wherein the first portion is attached to the first lever and the second portion is attached to the second lever. The pivot assembly may include a pivot hole for receiving a pivot point member for pivotally securing the levers. The apparatus may be equipped with end caps attached to each of the opposed portions of the pivot assembly A further embodiment includes a first and second lever pivotally secured to each other at a fulcrum point. The levers each include a terminal end and an opposed handle end. A pivot assembly secures the terminal ends of the first and second levers at the fulcrum point. The pivot assembly includes a first and a second opposed portion, wherein the first portion is attached to the first lever and the second portion is attached to the second lever whereby the opposed portions of the pivot assembly may rotate about each other.

A resilient member is further included which resides within the pivot assembly and housed within the opposed portions of the pivot assembly. The resilient member biases the handle ends of the first and second levers apart from each other, whereby resistance is created when the two handle ends are brought together.

An additional embodiment includes the apparatus for exercising the upper body comprising a first and second lever pivotally secured to each other at a fulcrum point, the levers each including a terminal end and an opposed handle end, wherein the fulcrum point is located at the terminal ends of the levers.

A pivot assembly securing the terminal ends of the first and second levers at the fulcrum point. The pivot assembly includes a first and a second opposed portion rotatively connected to each other, wherein the first portion is attached to the first lever and the second portion is attached to the second lever. The pivot assembly also includes a pivot hole for receiving a pivot point member for pivotally securing the levers.

The resilient member resides within the pivot assembly and is housed within the opposed portions of the pivot assembly. The resilient member biases the handle ends of the first and second levers apart from each other, whereby a resistance is created when the two handle ends are brought together by a user of the apparatus.

DRAWINGS

DETAILED DESCRIPTION

Disclosed is an apparatus for developing the upper body and in particular the chest. The apparatus includes opposed lever arms pivotally secured to each other at a fulcrum point located at the terminal ends of the opposed levers. The opposed lever arms are biased against each other such that a force is needed to bring the handle ends of the levers together. The force required to bring the opposed handles together exercises the upper body of a user.

The apparatus for exercising the upper body includes a pair of opposed pivotally secured lever arms. The lever arms are secured to each other using the pivot assembly. The opposed lever arms are biased against each other such that the apparatus appears to form a "V" shape, wherein the terminal ends of the arms are secured at the base of the "V" and handle ends form the open arms of the "V". The biasing of the arms may be accomplished using a resilient member residing within the pivot assembly. The two lever arms are biased to provide resistance for an exercise routine.

Referring now in greater detail to the drawings in which like numerals indicate like items throughout the several views, FIGS. 1-6 depict the present apparatus for exercising the upper body and in particular the chest, in the various embodiments of the present invention.

Figure 1:
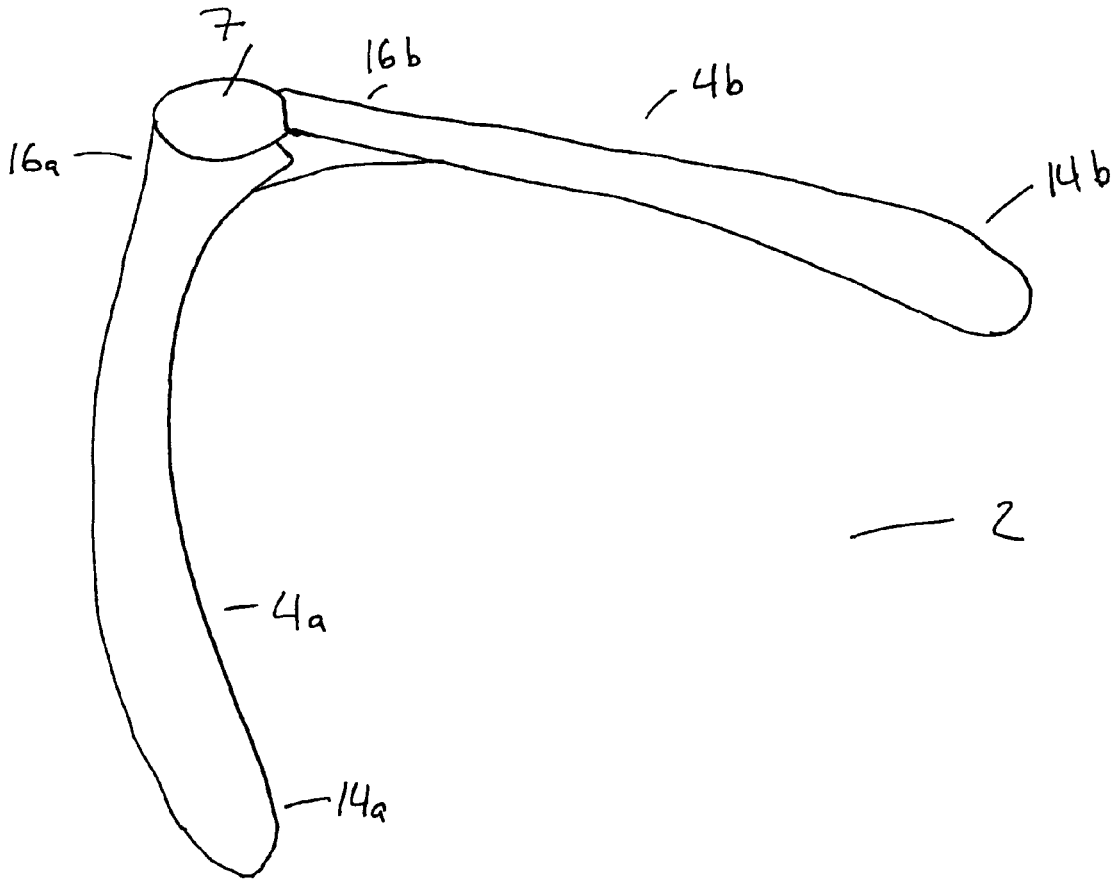
FIG. 1 is a side view of the present apparatus for developing the upper body and in particular the chest illustrating the lever arms.

Turning now to the FIGS. 1-6, the present apparatus is shown in various perspective views. The present apparatus for exercising the upper body 2 includes a pair of opposed pivotally secured lever arms 4(*a-b*). The lever arms 4(*a-b*) are secured to each other using the pivot assembly 7 as shown in FIG. 1. The pivot assembly 7 is only generally shown in FIG. 1 to provide a location for the assembly and includes the components as set forth in the various attached claims.

The opposed lever arms 4(*a-b*) are biased against each other such that the apparatus appears to form a "V" shape, wherein the terminal ends 16(*a-b*) of the arms 4(*a-b*) are secured at the base of the "V" and handle ends 14(*a-b*) form the open arms of the "V". The biasing of the arms 4(*a-b*) may be accomplished using a resilient member 8 residing within the pivot assembly 7 as shown in FIGS. 5 and 6.

Figure 2:
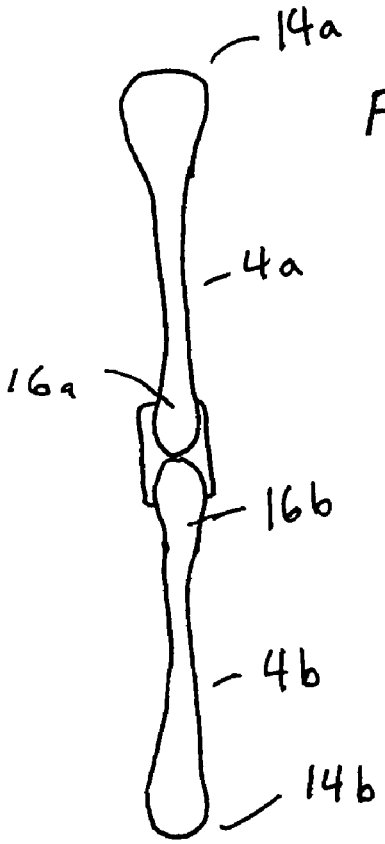
FIG. 2 depicts an embodiment of the present apparatus in a side view looking on at the biased handle ends of the lever arms.
Figure 3:
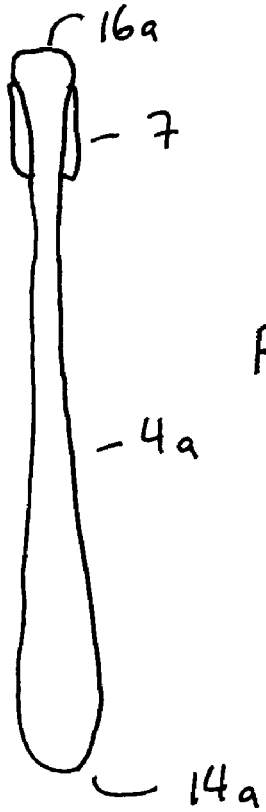
FIG. 3 shows an embodiment of the present apparatus in a side view looking across the apparatus such that only one arm is visible in this view.
Figure 4:
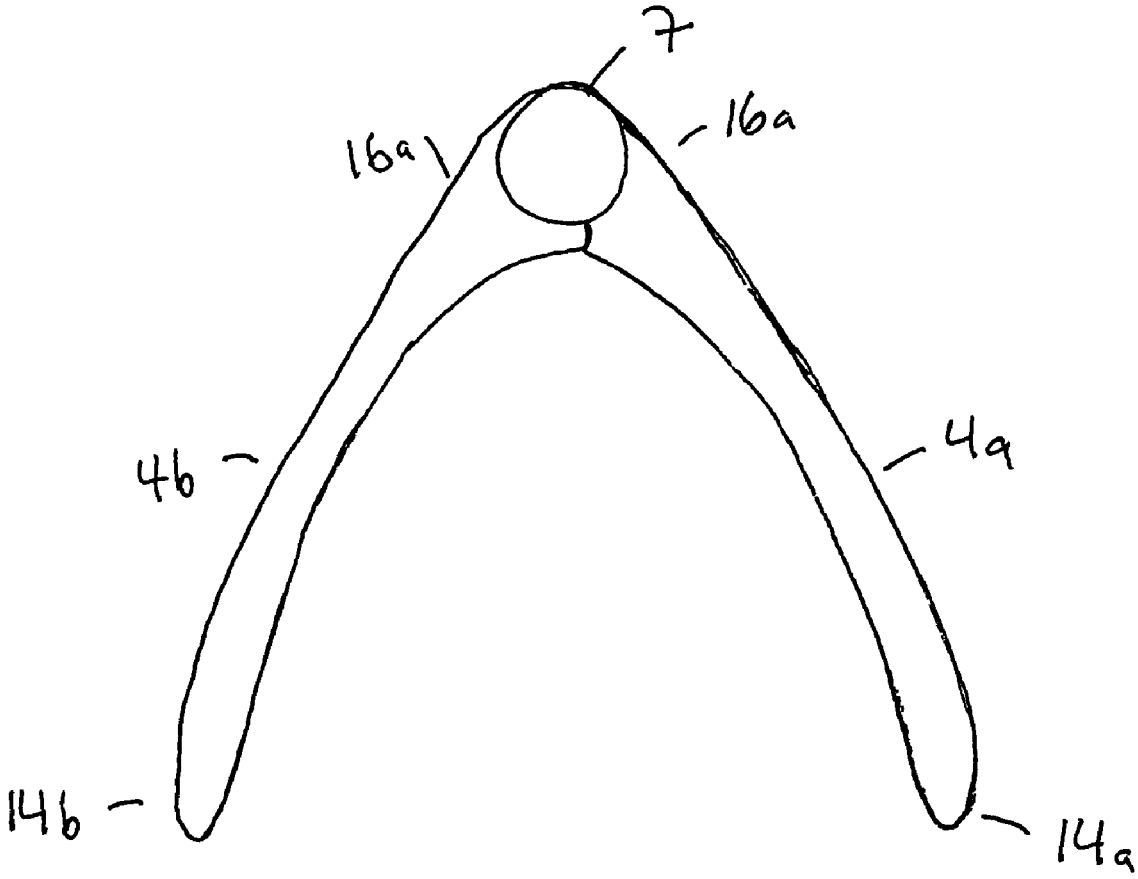
FIG. 4 illustrates a top view of the present apparatus.

Both FIGS. 2 and 3 show various side views of the present apparatus. FIG. 2 depicts an embodiment of the present apparatus in a side view looking on at the biased handle ends 14(*a-b*) of the lever arms 4(*a-b*). FIG. 3 shows an embodiment of the present apparatus in a side view looking across the apparatus 2 such that only one arm 4*a* is visible in this view.

The levers 4(*a-b*) may be formed from most any material, including plastic as is described in an embodiment of the apparatus. The lever arms 4(*a-b*) may have a curved shape such that when view on an angle in FIG. 4 the apparatus 2 form a "wishbone" appearance. Of course the present apparatus 2 may take on many shapes and is not limited to just the one shown in FIG. 4.

Figure 5:
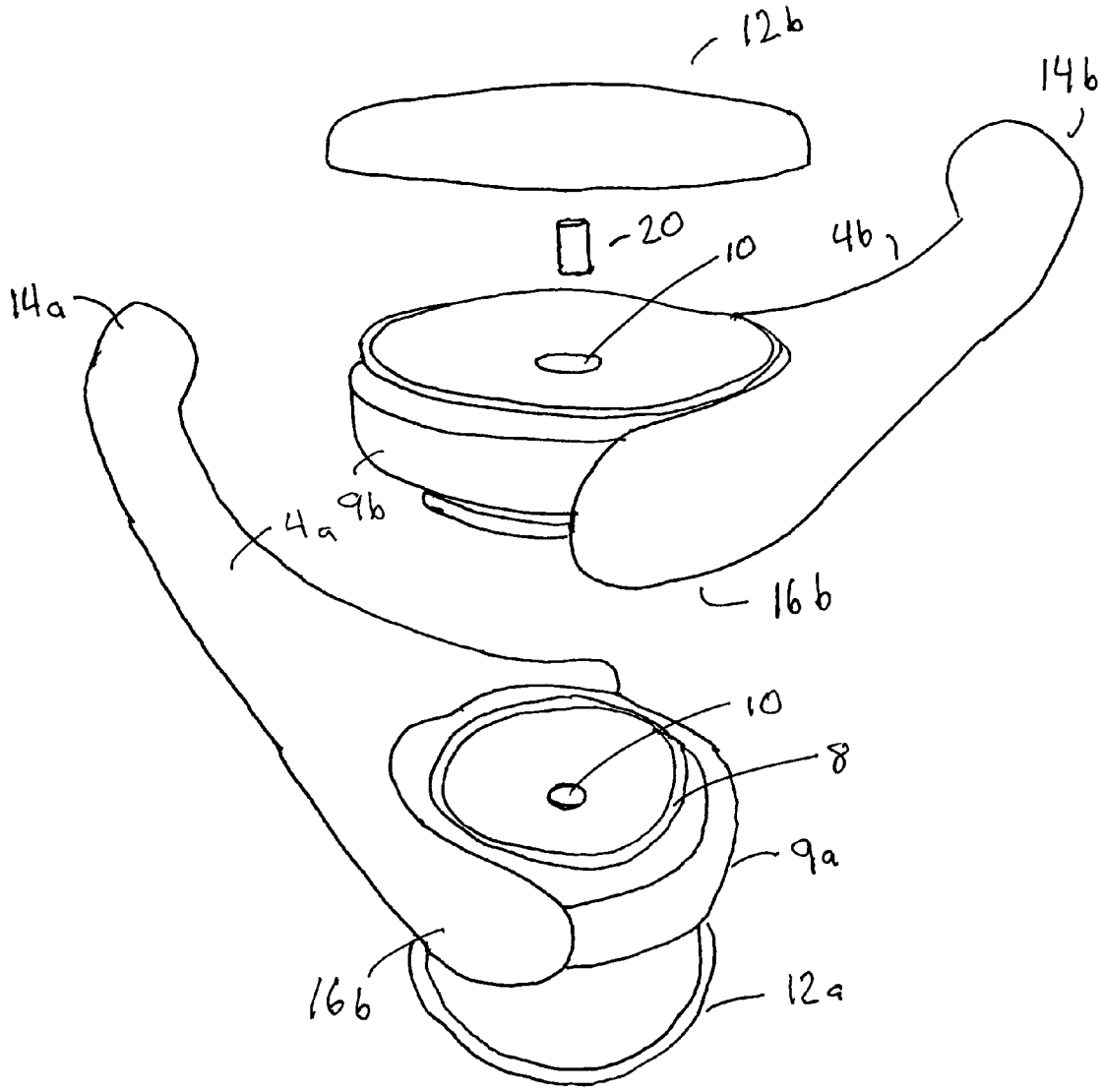
FIG. 5 depicts an expanded view of the apparatus for developing the upper body.
Figure 6:
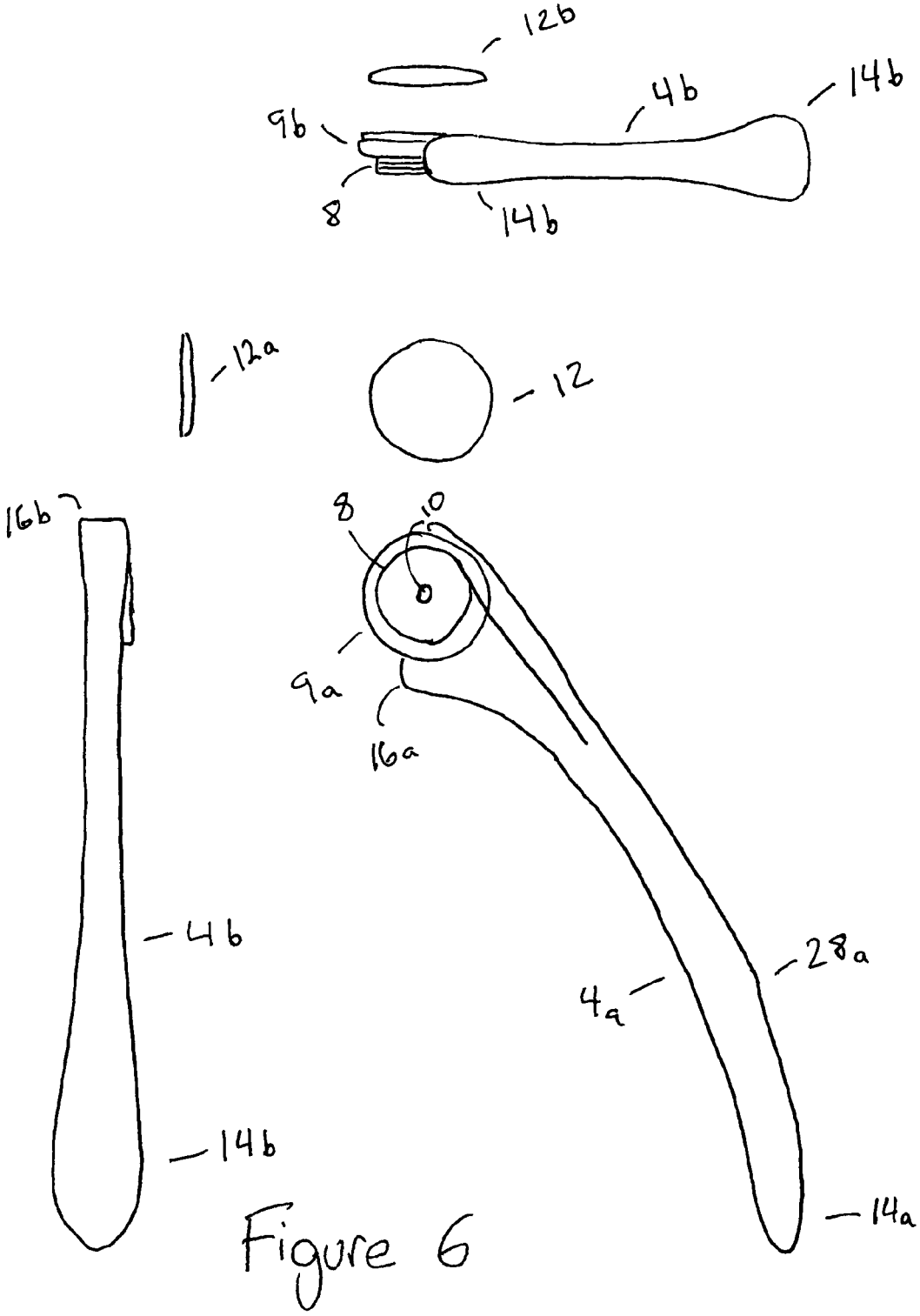
FIG. 6 shows an expanded view of the present apparatus.

As shown in the expanded views of both FIGS. 5 and 6 the apparatus 2 for exercising the upper body comprising a first and second lever arms 4(*a-b*) pivotally secured to each other at a fulcrum point 10 or pivot hole 10 in a further embodiment as shown in the figures. The fulcrum point 10 is located at the terminal ends 16(*a-b*) of the levers 4(*a-b*).

A pivot assembly 7 secures the terminal ends 16(*a-b*) of the first and second levers 4(*a-b*) at the fulcrum point 10. The pivot assembly 7 is generally described in the drawings and includes the components recited in the various claims. The pivot assembly 7 includes a first and a second opposed portion 9(*a-b*) rotatively connected to each other, wherein the first portion 9*a* is attached to the first lever 16*a* and the second portion 9*b* is attached to the second lever 16*b*. The attachment of the first portions 9(*a-b*) and the terminal ends 16(*a-b*) of the arms can be through any known means including being integrally formed with the arm 4(*a-b*). The pivot assembly 7 also includes a pivot hole 10 for receiving a pivot point member 20 for pivotally securing the levers 4(*a-b*).

The resilient member 8 resides within the pivot assembly 7 and is housed within the opposed portions 9(*a-b*) of the pivot assembly 7. The resilient member 8 biases the handle ends 14(*a-b*) of the first and second levers 4(*a-b*) apart from each other, whereby a resistance is created when the two handle ends 14(*a-b*) are brought together by a user of the apparatus 2. The handle portion 14(*a-b*) may further include grips 28 (*a-b*) made of most any material commonly known for such grips.

The resilient member 8 may be formed from any material capable of returning a stretched body to its original position. As illustrated in the figures, the resilient body 8 may be a spring. The spring 8 may be housed within the pivot assembly 7 and having a portion extending into arms 4(*a-b*) to aid in biasing them. Caps 12(*a-b*) may be attached to the pivot assembly 7 to complete the look of the apparatus 2.

The present apparatus may be for use in an exercise routine. The routine may consist of various exercises. For example, one routine may include bringing the elbows at shoulders level and the forearms straight up. Then the elbows and forearms are brought together as one presses the handles of the apparatus together. A further exercise includes bringing the elbows back and hands together to just under the chest while holding the apparatus. A third exercise routine may include bringing the arms and elbows straight down and bending the shoulders down about 5 degrees while pressing the handles together. A fourth routine may include bending down from the waist up by about 25 degrees with the elbows at waist level six inches from the body. With the forearms straight in front, they are brought together by squeezing the handle of the apparatus. The described routines may be done 4 times a day in repetitions beginning at 20 and increasing to about 40 or more.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of any claims that are derivable from the description herein, and any and all equivalents thereof.

What is claimed is:

1. An apparatus for exercising the upper body comprising:

an arm assembly consisting of a first and second lever arms pivotally secured to each other at a fulcrum point, the levers each including a terminal end and an opposed handle end, wherein the fulcrum point is located at the terminal ends of the levers, a pivot assembly securing the terminal ends of the first and second levers at the fulcrum point, the pivot assembly including a first and a second opposed portion rotatively connected to each other, wherein the first portion is attached to the first lever and the second portion is attached to the second lever, the pivot assembly also including a pivot hole for receiving a pivot point member for pivotally securing the levers; and a resilient member including terminal ends residing within the pivot assembly and the terminal ends of the resilient member extending out into the lever arms and the resilient member housed within the opposed portions of the pivot assembly, the resilient member biasing the handle ends of the first and second levers apart from each other, wherein a resistance is created when the two handle ends are brought together.

2. The apparatus for exercising the upper body of claim 1, further including grips attached to the handle ends.

3. The apparatus for exercising the upper body of claim 1, wherein the levers are formed from a plastic.

4. The apparatus for exercising the upper body of claim 1, further including end caps attached to each of the opposed portions of the pivot assembly.

* * * * *